US006149285A

United States Patent [19]

Cicarelli

[11] Patent Number: 6,149,285

[45] Date of Patent: Nov. 21, 2000

[54] INTERCHANGEABLE DECORATIVE TUBE DEVICE FOR FLUORESCENT LIGHTING

[76] Inventor: Gus M. J. Cicarelli, 248 S. Lemon St., Orange, Calif. 92866

[21] Appl. No.: 09/111,768

[22] Filed: Jul. 8, 1998

Related U.S. Application Data

[60] Provisional application No. 60/052,170, Jul. 10, 1997.

[51] Int. Cl.[7] ..... F21V 23/02; F21V 14/00

[52] U.S. Cl. ..... 362/255; 362/223; 362/256

[58] Field of Search ..... 362/222, 223, 362/255, 256, 293, 311, 356, 361; 353/43, 120

[56] References Cited

U.S. PATENT DOCUMENTS

| | | | |
|---|---|---|---|
| 3,791,058 | 2/1974 | Mollica | 40/106.52 |
| 4,562,515 | 12/1985 | Lautzenheiser | 362/33 |
| 4,727,459 | 2/1988 | Palumbo | 362/260 |
| 4,864,475 | 9/1989 | Jung | 362/231 |
| 5,016,143 | 5/1991 | Aikens | 362/32 |
| 5,307,244 | 4/1994 | Gaudette | 362/29 |
| 5,416,674 | 5/1995 | Murai | 362/84 |
| 5,442,526 | 8/1995 | Stowe, Jr. | 362/61 |

*Primary Examiner*—Cassandra Spyrou
*Assistant Examiner*—Jared Treas
*Attorney, Agent, or Firm*—Robert P. Bell

[57] ABSTRACT

An elongated thin wall plastic tube device, containing decorative un-printed images along its length as transparent light-transmissive openings, while also containing printed or painted opaque sections to block out unwanted light-transmission around the images. The decorative tube device will surround a fluorescent light bulb color sleeve, which in combination with a fluorescent light bulb are inserted into a fluorescent lighting fixture. Once the fixture is powered on, the light transmitted by the light bulb passes through the color sleeve and through the un-printed image openings, while the opaque sections block out unwanted light around the images and throughout the remaining sections of the decorative tube device. When illuminated, the apparatus give the appearance of neon signage at a fraction of the cost of conventional neon signs.

13 Claims, 3 Drawing Sheets

INTERCHANGEABLE DECORATIVE TUBE DEVICE FOR FLUORESCENT LIGHTING

CROSS-REFERENCE TO RELATED APPLICATIONS

The present application claims priority from Provisional U.S. patent application Ser. No. 60/052,170, filed Jul. 10, 1997 and incorporated herein by reference.

FIELD OF THE INVENTION

This present invention relates to lighting fixtures and illuminated signage. In particular, the present invention relates to an elongated fluorescent lighting decorative tube device which may be slid over a prior art fluorescent light bulb to create a decorate lighting effect or a neon-like sign.

BACKGROUND OF THE INVENTION

Neon signs are well known in the art. Such signs have been particularly popular due to the way their intense coloration and brightness attracts attention, and therefor customers. Artists have used neon as an artistic medium as well.

Neon signage, however, is expensive. Most neon signs may require painstaking hand craftsmanship, involving careful glass bending and blowing of individual shapes, and charging and testing of individual tubes. In addition, different colors require different gases within each tube, making multi-colored signs expensive.

Neon signs are also difficult and expensive to maintain, and break easily. Roadway signs are easy targets for vandals and the like. Once damaged, a neon sign owner must obtain the services of a neon sign craftsman to make and install new tubes. Old tubes, even if not damages, may start to flicker and buzz, giving the sign a seedy and disreputable appearance.

As a result, other types of illuminated signage have become popular. Back-lit signs, using fluorescent tubes encased within a translucent (e.g., white) housing have been popular. However, such signs have been criticized as being aesthetically displeasing. In addition, such signs may weather with age,a nd are also subject to brittle breakage.

For indoor use, a form of faux neon has become popular using edge lit plexiglass™ sheets, lit with ultraviolet or "black" light. Sign elements may be painted into grooved portions of the plexiglas sheet using fluorescent paints or the like. Grooving and painting the plexiglas may be rather expensive, however, and such signs have generally found acceptance only for indoor use. In addition, black light tubes may be as much as 5 to 10 times as expensive as conventional fluorescent lamps.

Colored tubes for colorizing fluorescent or neon tubes are also known in the art. Such colored sleeves may typically slide over a standard (e.g., 48 inch) fluorescent tube to provide a colored light effect. Clear tubes are also known for protecting fluorescent tubes from breakage.

Murai, U.S. Pat. No. 5,416,674, issued May 16, 1995, discloses a black light display device. An ultraviolet radiation lamp contains a transparent tube that coaxially receives the ultraviolet lamp and which is rotatable about an axial center line. Images are painted or printed on either the outer surface of the ultraviolet lamp, or on a substantially transparent film placed over the surface of the transparent tube, with a fluorescent ink which emits light when ultraviolet light is radiated upon it. The lighted images are projected onto a concave reflective surface, which may also have images painted on it with a fluorescent ink.

Jung U.S. Pat. No. 4,864,475, issued Sep. 5, 1989, discloses a rainbow light box. A colorful illuminated sign construction utilizes plurality of fluorescent lamp covered by colored transparent plastic thin wall tubing which is tightly enclosed by a diffusion panel sleeve so that neighboring colors may be diffused by the diffusing panel. It is said to form colorful stripes to attract attention. The fluorescent lamps and color sleeves are held by openings installed on side frame posts at both ends of fluorescent lamp. The side frame posts are connected to horizontal conduit and connecting bar which forms a structural frame of sign.

Palumbo, U.S. Pat. No. 4,727,459, issued Feb. 23, 1988, discloses a technique for surrounding a neon tube with a clear or tinted plastic tube. Palumbo teaches that the use of the clear or tinted plastic tube enhances the lighting effect of the neon tube.

SUMMARY AND OBJECTS OF THE INVENTION

The present invention relates to an elongated fluorescent lighting decorative tube device which is interchangeable and intended for use in combination with existing fluorescent light bulb, fluorescent light bulb color sleeve, and fluorescent lighting fixture. When combined, the decorative tube device is particularly useful for the purpose of creating bright and colorful illuminative images highly similar to neon lighting as a focus of decorative attention.

Combinations of fluorescent light bulb color sleeves and fluorescent lighting are well known in the lighting, display and sign industry because of their simple and effective purpose of providing bright and colorful illuminative attention.

Many other reasons for using fluorescent color sleeves as illuminative attention exist. First, fluorescent color sleeve lighting is inexpensive. Second, fluorescent color sleeve lighting is convenient. Third, fluorescent color sleeve lighting provides wide color variations. Fourth, fluorescent color sleeve lighting is interchangeable. Fifth, fluorescent color sleeve lighting utilizes low energy consumption. Sixth, fluorescent color sleeve lighting is dependable. Seventh, fluorescent color sleeve lighting is light weight. Eighth, fluorescent color sleeve lighting is available in many size variations. Ninth, fluorescent color sleeve lighting is durable.

Fluorescent color sleeve lighting alone merely provides plain solid colors as illuminative attention. Fluorescent color sleeve lighting alone does not provide any interesting effects for attention, it merely provides solid illuminative colors.

However, by adding this new and unique interchangeable accessory of a decorative tube device to surround such plain color sleeve presents the same benefits mentioned above, while at the same time creating bright and colorful illuminative images highly similar to neon at a fraction of the cost. Moreover, the apparatus of the present invention is much more durable or more readily repairable than conventional neon. Standard fluorescent lamps may be changed by a layman without the need for consulting with a neon craftsman to custom make replacement tubing. If the lamp of the present invention is broken, the broken fluorescent tube may be removed and replaced and the color sleeve and printed sleeve reused.

Therefore, it is an object of the present invention to provide a decorative tube device in which its task is that of creating bright and colorful illuminative images highly similar to neon lighting from a combined fluorescent light source.

Another object of the present invention is to provide a decorative tube device which will surround a fluorescent light bulb color sleeve.

Another object of the present invention is to provide a decorative tube device which is interchangeable with variable types of fluorescent light bulb color sleeves.

Another object of the present invention is to provide a decorative tube device with unlimited image design options and variations.

BRIEF DESCRIPTIONS OF THE DRAWINGS

Figure 4:
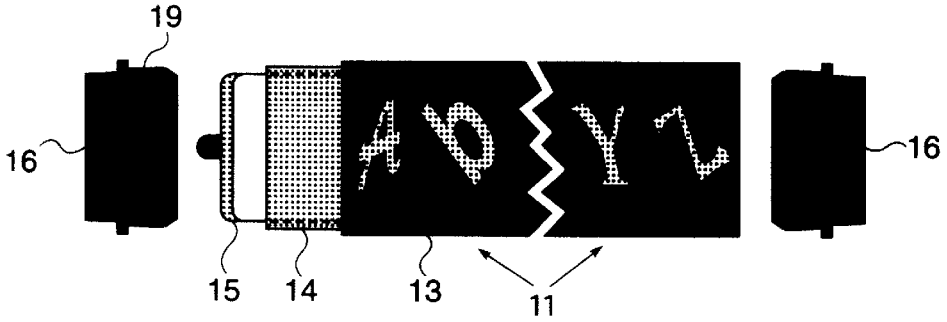
FIG. 4 is a sectional side view illustrating the decorative tube device, fluorescent tube, and tube sleeve in accordance to the present invention.
Figure 4A:
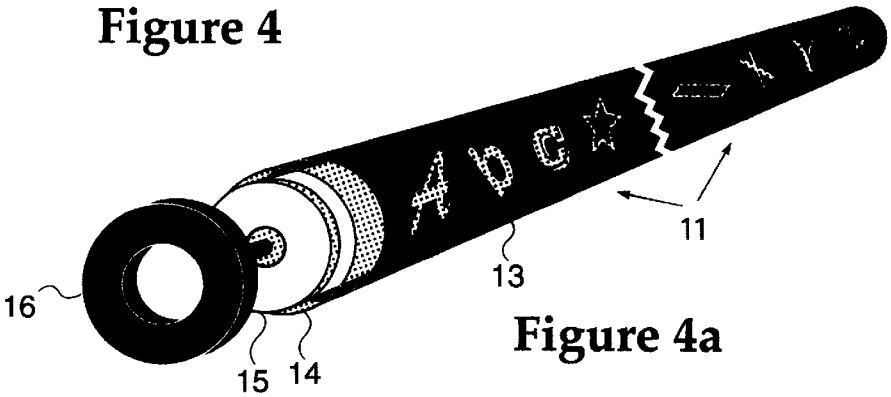

FIG. 4*a* is an exploded perspective view illustrating the decorative tube device, fluorescent tube, and tube sleeve in accordance to the present invention.

Figure 5:
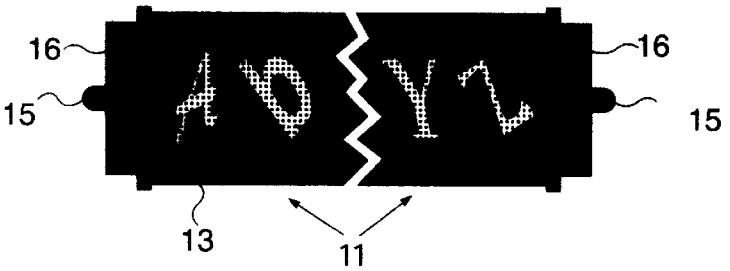

FIG. 5 is a sectional side view illustrating the decorative tube device assembled with a fluorescent tube and tube sleeve in accordance with the present invention.

Figure 5A:
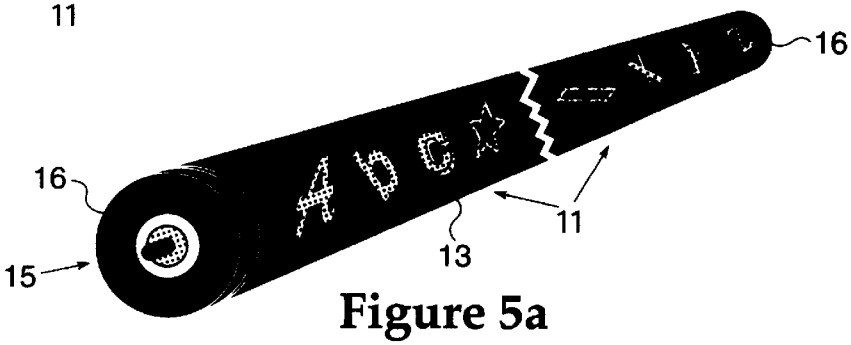

FIG. 5*a* is a sectional perspective view illustrating the decorative tube device assembled with a fluorescent tube and tube sleeve in accordance with the present invention.

Figure 6:
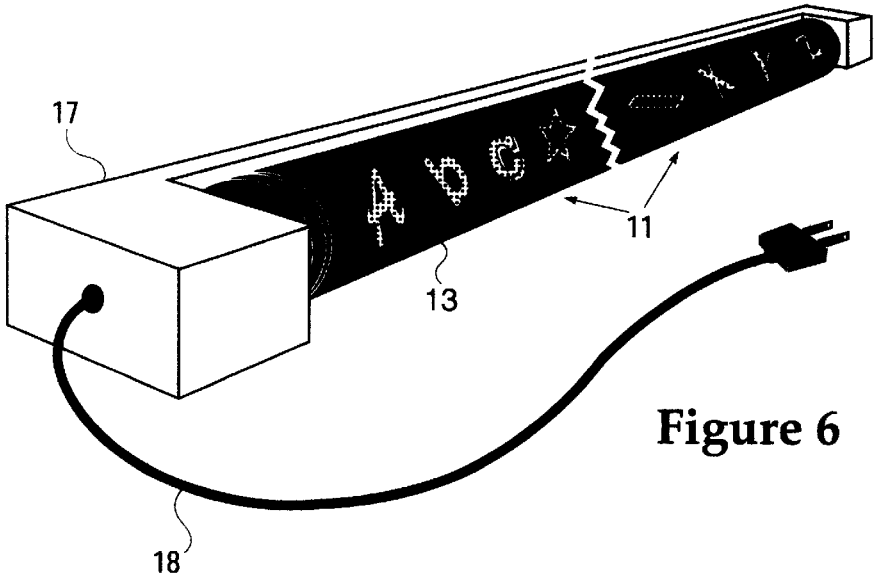

FIG. 6 is a sectional perspective view illustrating the combination of decorative tube device, a fluorescent tube, and tube sleeve, inserted into fluorescent lighting fixture in accordance with the present invention.

Figure 6A:
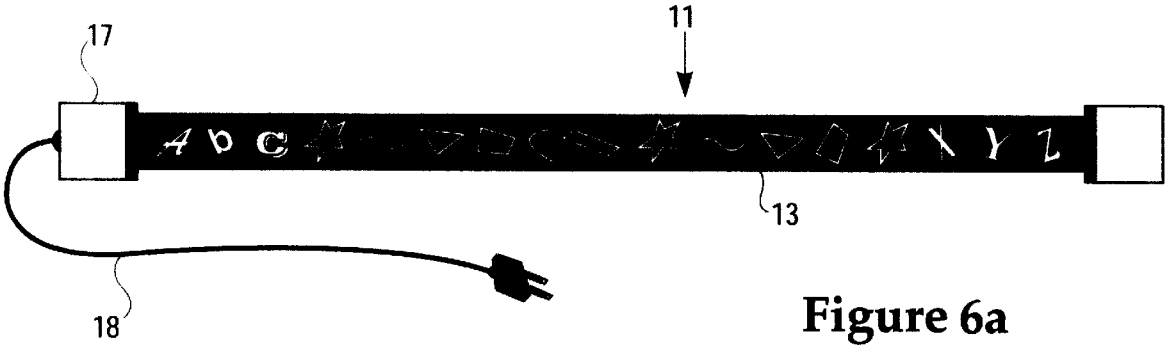

FIG. 6*a* is a side view illustrating the combination of decorative tube device, a fluorescent tube, and tube sleeve, inserted into another type of fluorescent lighting fixture in accordance with the present invention.

DETAILED DESCRIPTION OF THE INVENTION

Figure 1:
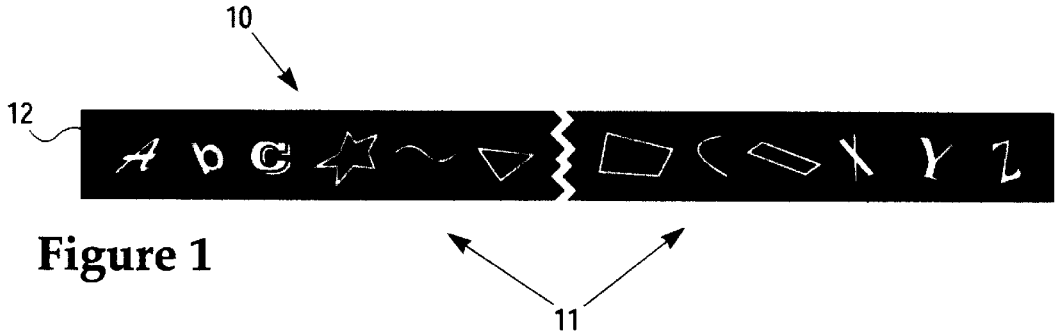
FIG. 1 is a sectional flat view illustrating a transparent film embodiment with un-printed images as well as illustrating applied printed or painted opaque sections in accordance with the present invention.

Referring now to FIG. 1, which illustrates a flat view illustrating the preferred film embodiment 12. As used herein, the term "film" means that of any printable thin clear plastic material such as, for example, transparent acrylic, styrene, polycarbonate or any other suitable transparent printable material that might be interpreted as film 12.

Figure 2:
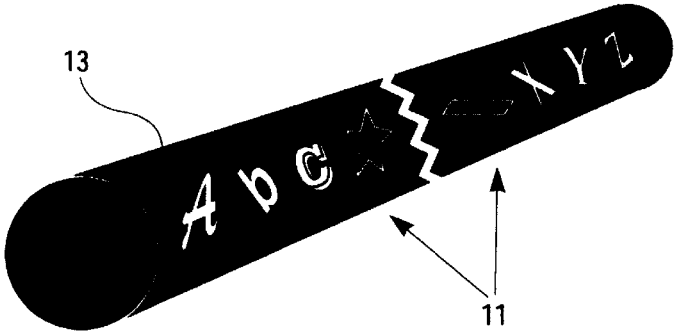
FIG. 2 is a sectional perspective view illustrating a printed film embodiment formed as decorative tube device in accordance with the present invention.

In the preferred embodiment, film 12 may be formed flat as illustrated in FIG. 1, and then rolled into a tube or sleeve shape as illustrated in FIG. 2. Film 12 may be formed into a tube by rolling and securing with tape or other adhesive. However, film 12 may also be formed in a tube or sleeve form as illustrated in FIG. 2. As may be appreciated by one of ordinary skill in the art, film 12 may be more readily printed with indicia in flat form.

Further, film embodiment 12 is illustrated having four edges and with applied printed or painted opaque sections 10 along length of film 12 along with un-printed example images 11 which are left out as transparent openings along length of film 12 to allow light-transmission. Painted opaque sections 10 may comprise opaque, translucent, or semi-transparent sections, so long that a contrast is generated between opaque sections 10 and un-printed images 11. In the preferred embodiment, opaque sections 10 may be opaque black. In other words, un-printed example images 11 such as the ABC (e.g., text), star, wave, triangle, or the like, are not printed on film 12.

Printed opaque sections 10 (in association with un-printed image openings) may be applied on either side of film 12 by a suitable means such as silk printing, screen printing, photo-negative process or others alike which may commonly be provided by those skilled in the art of commercial printing and design services. Also, to acquire the described preferred effects of this invention, it is suggested, but not limited to, having printed opaque sections 10, extend to all four edges of film 12 as illustrated in FIG. 1, in order to block out unwanted light so that light illustrates only through the un-printed images 11.

Many designs may be chosen for decorative image openings of this invention. A few ideas, examples, options and variations may be: unusual tilted, angled or stretched shapes, unusual or contemporary patterns, waved, straight, thin, or thick lines, scattered or splattered markings, wild lettering, etc.

Further, plain lettering, words, symbols or insignia may be chosen for advertising or informational purposes. However, if words or lettering is chosen, it would be preferable to center them along the length of film 12 in order to be able to read them when light-transmission occurs.

FIG. 2 is a sectional perspective view illustrating that once printed film 12 is printed, it is then formed together with a bonding agent or other similar available bonding means to form an elongated tube. Printed film 12 is formed together in order to surround fluorescent light bulb color sleeve 14 as illustrated in FIG. 4. In the preferred embodiment, printed film 12 should surround snugly, but not tightly, over fluorescent light bulb color sleeve 14.

As used herein, the term "fluorescent light bulb color sleeve" means color sleeve 14 as illustrated in the Figures. Color sleeve 14 may comprise transparent, semi-transparent, or translucent plastic (preferably polycarbonate) tubing each of which has distinct color and transparency such as the sleeves developed by Diversified Lighting Products, Inc., Farmingdale, N.Y. It should be noted that when no color is desired, color sleeve 14 may be eliminated. Moreover, if a colored fluorescent tube is used, color sleeve 14 may be dispensed with.

Figure 3:
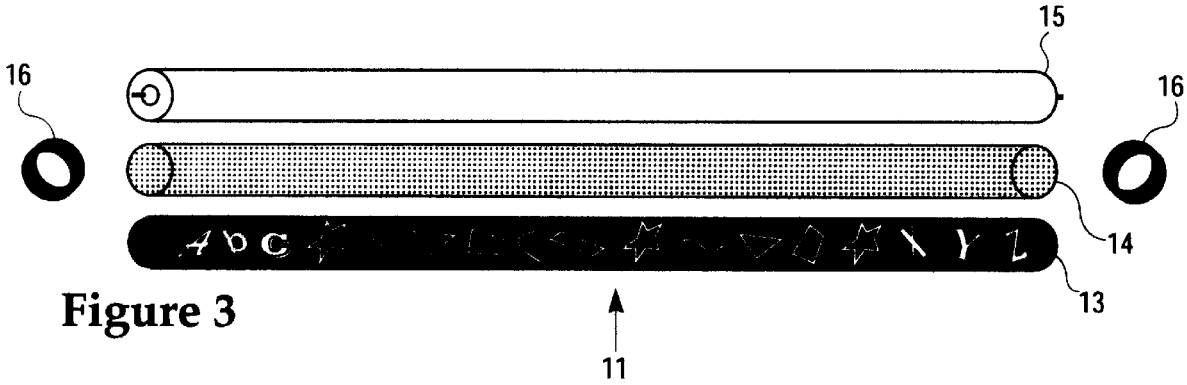
FIG. 3 is an elevated side view illustrating the decorative tube device of the present invention along with a prior art fluorescent tube and tube sleeve.

FIG. 3 is an elevated side view illustrating all embodiments arranged next to each other in order to illustrate an overall better understanding of what is being described in accordance to this invention, in which fluorescent light bulb 15, color sleeve 14, decorative tube device 13 and a pair of plastic fluorescent sleeve end-caps 16 are illustrated.

FIG. 4 and FIG. 4*a* are, respectively, a sectional side view and accompanying sectional perspective view illustrating all embodiments in arrangement according to this invention in which fluorescent light bulb 15 is interposing into color sleeve 14, and color sleeve 14 is interposing into decorative tube device 13. The dotted lines in FIG. 4 illustrate fluorescent light bulb 15 interposing into color sleeve 14 illustrating color sleeve 14 as transparent.

Once fluorescent tube 15 and color sleeve 14 are interposed into decorative tube device 13, fluorescent sleeve end-caps 16 may then be placed on both ends to enclose described embodiments in combination. Various types of end-caps 16 are available and common to the fluorescent fixture industry. However, in the preferred embodiment, end-cap 16 may comprise model #L-138 developed by Anthony Manufacturing. The Anthony end-cap may be used in accordance to this invention because of its type of "rim" 19 around its outer casing which is intended to act as a wall or as a stop to assist snug fit of color sleeve 14 with fluorescent light bulb 15. Other end caps may be available from Diversified Lighting Products of Farmingdale, N.Y., but may not have the advantageous rim. In addition, it is also possible to use the device without an end cap, however light leakage around the end of fluorescent tube 15 may be a problem. If a housing or the like is provided to cover the end of fluorescent tube 15 to prevent light leakage, an end cap may not be necessary.

FIG. 5 and FIG. 5*a* are, respectively, a sectional side view and accompanying sectional perspective view illustrating decorative tube device 13 surrounded and enclosed in combination with described embodiments in accordance to this invention.

FIG. 6 and FIG. 6*a* are, respectively, a sectional perspective view and accompanying side view illustrating that once decorative tube device 13 is enclosed in combination with described embodiments, thenceforth, all combined embodiments may be inserted into fluorescent lighting fixture 17.

When electrical power is supplied to power supply cord 18 and fluorescent lighting fixture 17 is powered on, fluorescent light bulb 15 starts transmitting light through color sleeve 14 and through the decorative image openings 11 of decorative tube device 13 creating bright and colorful illuminative images 11 particularly similar to neon lighting for attracting attention.

A decorative tube device in accordance to this invention, with above described combinations, ideas, examples, options, and variations is unlimited.

While the preferred embodiment and various alternative embodiments of the invention have been disclosed and described in detail, it may be apparent to those skilled in the art that various changes in form and detail may be made therein without departing from the spirit and scope thereof. Also, it is intended that all matter contained in the above description or shown in the accompanying drawings shall be interpreted as illustrative and not in a limiting sense.

For example, in the preferred embodiment, it is disclosed that the printed sleeve may selectively transmit light passing through a colored sleeve. However, in an alternative embodiment, the two sleeves may be combined as one unit. For example, a colored sleeve may have printed portions formed thereon for selectively blocking light transmission.

I claim:

1. An illuminated sign lighting apparatus for generating an illuminated image, said illuminated sign lighting apparatus comprising:

a fluorescent light tube to provide a light source for generating light through said image;

a fluorescent light fixture having a substantially elongated base portion substantially the same length as the fluorescent light tube, two electrical connection portions each connectable to respective ends of said fluorescent light tube, and a power supply for supplying electrical power through the two electrical connection portions to the fluorescent light tube;

a first color sleeve surrounding the fluorescent light tube for coloring the light transmitted through said image, said first color sleeve having a diameter substantially the same as the diameter of the fluorescent light tube so as to be slidably fittable over said fluorescent light tube so as to be supported by said fluorescent tube; and a second substantially opaque sleeve surrounding the first color sleeve, having decorative light transmissive portions forming said image as light-transmissive openings along a portion of the first color sleeve and applied opaque printed sections for blocking light-transmission around said image, said second substantially opague sleeve having a diameter substantially the same as the first color sleeve so as to be slidably fittable over said first color sleeve so as to be supported by said fluorescent tube.

2. The lighting apparatus of claim 1, further comprising:

a pair of fluorescent sleeve end-caps, attached at ends of the fluorescent light tube to enclose said fluorescent light tube with said first color sleeve and said second substantially opaque sleeve.

3. The illuminated sign apparatus of claim 2 wherein the substantially opaque sleeve comprises one of a transparent acrylic, styrene, or polycarbonate film.

4. A device for use with a fluorescent tube for creating a visual effect comprising:

a printed film formable into a substantially opaque round cylindrical sleeve slidably fittable over the fluorescent tube, the round cylindrical sleeve having a diameter substantially the same as the fluorescent tube and a length substantially the same as the fluorescent tube so as to be supportable by the fluorescent tube when slid over the fluorescent tube, the printed film having decorative un-printed portions forming images as light-transmissive openings along a portion of the substantially opaque sleeve and applied opaque painted sections on the printed film blocking light-transmission around said images.

5. The device of claim 4, wherein the film comprises one of a transparent acrylic, styrene, or polycarbonate film.

6. The device of claim 4, further comprising:

a color sleeve for surrounding the fluorescent light tube to color light transmitted through said images, said color sleeve having a diameter substantially the same as said fluorescent light tube so as to be slidably fittable over said fluorescent light tube.

7. A method of making a film for use with a fluorescent light fixture having at least one fluorescent light tube, said method comprising the steps of:

forming a flat film having predetermined dimensions such that when the film is rolled into a round cylindrical tube, the tube has a diameter slightly larger than a diameter of the fluorescent light tube, and a length substantially the same as the fluorescent light tube;

forming printed indicia on the flat film;

forming the flat film into a round cylindrical tube shape;

securing the flat film into the round cylindrical tube shape tube with one of a tape or adhesive; and sliding the flat film formed into the round cylindrical tube shape over the fluorescent light tube such that the fluorescent tube supports the round cylindrical tube, and light from the fluorescent light tube is transmitted through at least a portion of the flat film formed into the round cylindrical tube shape.

8. The method of claim 7, wherein said step of forming printed indicia on the flat film comprises the steps of:

applying printed non-transparent sections along length of the flat film along with un-printed portions forming images which are left out as light transmissive portions along length of flat film to allow light-transmission.

9. The method of claim 8, wherein said printed non-transparent sections comprise one or more of opaque, translucent, or semi-transparent sections providing a contrast between the non-transparent sections and the light transmissive portions.

10. The method of claim 9, wherein said printed non-transparent sections are formed on either side of the flat film by one or more of silk printing, screen printing, photo-negative process.

11. The method of claim 10, further comprising the step of:

sliding a semi-transparent colored plastic sleeve over the fluorescent tube prior to sliding the flat film formed into the tube shape over the fluorescent light tube, said semi-transparent colored plastic sleeve having a diameter substantially the same as the fluorescent light tube so as to be slidably fittable over the fluorescent light tube.

12. The method of claim 11, further comprising the step of:

attaching an end cap over an end portion of the fluorescent tube, the semi-transparent colored plastic sleeve, and the flat film formed into the round cylindrical tube shape.

13. The method of claim 12, wherein said step of forming a flat film comprises the step of forming a flat film from one of a transparent acrylic, styrene, or polycarbonate film.

* * * * *